US005695327A

United States Patent [19]

Heinen et al.

[11] Patent Number: 5,695,327

[45] Date of Patent: Dec. 9, 1997

[54] SEALING, MOUNTING AND DRIVE OF THE ROTORS OF A DRY-RUNNING SCREW COMPRESSOR

[75] Inventors: Manfred Heinen, Rees; Hans-H. Reinersmann, Essen, both of Germany

[73] Assignee: MAN Gutehoffnungshüte Aktiengesellschaft, Oberhausen, Germany

[21] Appl. No.: 628,578

[22] Filed: Apr. 4, 1996

[30] Foreign Application Priority Data

Apr. 8, 1995 [DE] Germany ..... 195 13 380.3

[51] Int. Cl.[6] ..... F04C 18/16; F04C 27/00

[52] U.S. Cl. ..... 418/144; 418/201.1

[58] Field of Search ..... 418/131, 133, 418/135, 201.1, 144

[56] References Cited

U.S. PATENT DOCUMENTS

| | | | |
|---|---|---|---|
| 2,746,394 | 5/1956 | Dolza et al. | 418/201.1 |
| 4,490,102 | 12/1984 | Carre et al. | 418/201.1 |

FOREIGN PATENT DOCUMENTS

| | | | |
|---|---|---|---|
| 3609996 | 10/1987 | Germany | 418/201.1 |
| 44 03 648 A1 | 8/1995 | Germany . | |
| 44 03 649 A1 | 8/1995 | Germany . | |
| 62-107285 | 5/1987 | Japan | 418/201.1 |
| 636417 | 4/1950 | United Kingdom | 418/201.1 |

*Primary Examiner*—John J. Vrablik
*Attorney, Agent, or Firm*—McGlew and Tuttle

[57] ABSTRACT

The present invention pertains to a dry-running screw compressor, in which the suction-side bearing housing and the pressure-side bearing housing are provided on the inside with journals for engaging holes in the rotors. The two rotors within the compressor housing include only the body of the ribbed rotor and grooved rotor, and the journals of the rotors, which are located on the outside for mounting, are eliminated. The rotors are mounted on the pressure-side journals by means of radial and thrust bearings which are secured by corrugated nuts. Only radial bearings are used on the suction-side journals. The sealing between the tooth spaces of the rotors is ensured by means of sealing disks. To maintain the distance between the rotor faces, gearwheels are inserted on the pressure side between the sealing housing and the bearing housing. The ribbed rotor is driven in this exemplary embodiment with a coupling half for the drive via a torsion shaft.

10 Claims, 2 Drawing Sheets

SEALING, MOUNTING AND DRIVE OF THE ROTORS OF A DRY-RUNNING SCREW COMPRESSOR

FIELD OF THE INVENTION

The present invention pertains to a dry-running rotor compressor with intermeshing between a helically geared ribbed rotor and a helically geared grooved rotor, wherein the suction-side and pressure-side bearing housings have journals which extend into holes within the rotors and are provided with plain or rolling bearings; with a torsion shaft led through a hole in the suction-side or pressure-side bearing housing and through a journal, with a coupling half for the compressor drive, and with seals arranged on the bearing housings and on the rotors.

BACKGROUND OF THE INVENTION

As a forcibly delivering positive-displacement machine, a screw compressor correspondingly transports the medium being delivered not only from the suction side to the pressure side, but it also compresses it this way due to a reduction of the tooth spaces. If the runners or rotors rotate in the housing, they become disengaged on the suction-side control edge, so that a cross section and a volume open for suction. The rotors will mesh again at their control edges during further rotation. The cross section of the work space moving in the axial direction becomes smaller up to the control edge on the pressure side of the housing, at which the compressed medium is pushed out.

Screw compressors may be driven directly at the speed of the motor via a built-in or external gear mechanism.

Screw compressors with low compression ratios (final pressure/suction pressure), in which the medium being delivered must not be contaminated with a cooling liquid, are called dry-running screw compressors or dry runners, and they require a differential gear, which protects the rotors from contact, to maintain the distance between the rotor surfaces.

The rotors of these screw compressors have journals arranged on both sides, which are mounted in thrust bearings and radial bearings in the housing.

The great sag of the rotors and the simultaneous occurrence of high torsional and bending stresses on the driven rotor journals are disadvantageous in this design. To impart the highest possible rigidity to the rotors or to make it possible to transmit the necessary torques, the bearing journals are made as large as possible. The consequence of this is that the bearing distance and the distance between the bearings also must be selected to be correspondingly large.

A screw compressor with oil injection, which has inner rotor mounts, has been known from the previously unpublished P 44 03 649.3. The bearing journals for the main rotor and the auxiliary rotor are always parts of the suction-side and pressure-side bearing housing, respectively, and therefore consist of the same material, e.g., cast steel. The journals extend into holes of the rotors, which are provided with plain bearings or roller bearings for mounting the journals.

One particular economic advantage of this bearing design can be considered to be the fact that the screw compressor thus designed has an extremely short design compared with compressors in which the rotors have journals arranged on both sides.

Thrust bearings and radial bearings may be optionally used for mounting on the suction side, and radial bearings on the pressure side, or radial bearings may be used on the suction side and thrust bearings and radial bearings on the pressure side.

The drive of the screw compressor may be arranged at one of the suction-side or pressure-side rotor ends.

Besides couplings of any desired design, it is also possible to use for the drive, e.g., a torsion shaft, which is led through a hole in the suction- or pressure-side bearing housing and into one of the four journals. The compressor is driven via a coupling at the outer end of the torsion shaft.

In addition, the sealing of the faces of the rotors of a screw compressor with oil injection against the housing by means of sealing disks to achieve sealing of the active space between a helically geared ribbed rotor and a helically geared grooved rotor has also been known from the previously unpublished P 44 03 648.5.

Sealing disks are located between the faces of the rotors and the housing on the suction-side and pressure-side housing parts, and these sealing disks are screwed or bonded to these housing parts, or they are inserted in a positive-locking manner. The sealing disks consist of a sintered PTFE-mica mixture or a material possessing similar properties.

SUMMARY AND OBJECTS OF THE INVENTION

The basic object of the present invention is to reduce the load on the driven journals even in a dry-running screw compressor, to impart, on the whole, a higher rigidity to the rotors, and to provide a screw compressor of an extremely short design.

This object is attained according to the present invention by providing a dry-running rotor compressor with a helically geared ribbed rotor and a helically geared grooved rotor which intermesh, wherein a suction side and a pressure side bearing housing is provided with journals which extend into holes within the rotors and are provided with plain bearings or roller bearings. A torsion shaft of a coupling half of the compressor drive is provided lead through a hole in the suction- or pressure side bearing housing and through one of the journals, with seals arranged on the bearing housings and the rotor ends. A differential gear with gear wheels is provided as well as a sealing housing with sealing disks and with seals arranged between the pressure-side ends of the rotors and the bearing housing. Seals as well as another sealing housing and sealing disks are arranged between the suction-side ends of the rotor and the bearing housing.

According to the present invention, the screw compressor has inner rotor mounts. The bearing journals for the main rotor and the auxiliary rotor are always parts of the suction-side and pressure-side bearing housing, respectively, and consist of the same material, e.g., east steel. The journals extend into holes of the rotors, which are provided with plain bearings or rolling bearings for mounting the rotors.

Thrust bearings and radial bearings are optionally used for mounting on the suction side and radial bearings on the pressure side, or radial bearings are used on the suction side and thrust bearings and radial bearings on the pressure side.

The drive of the screw compressor may be arranged at one of the suction-side or pressure-side rotor ends. Gearwheels of a differential gear, as well as a sealing housing with sealing disks and seals are arranged between the pressure-side ends of the rotors and the pressure-side bearing housing. Only sealing housings, sealing disks and seals are provided between the suction-side ends of the rotors and the suction-side bearing housing.

The sealing of the compression space against the environment is achieved with seals which are arranged in a sealing housing on the pressure side and likewise in a sealing housing, which is fastened in the suction-side bearing housing, on the suction side and are directed toward the rotor faces.

Corresponding to the pressure level and the type of the medium to be delivered, identical or different seals may be used at the four rotor ends.

It is possible to use as seals, e.g., gasproof seals, which meet especially high requirements in terms of sealing.

The tooth spaces are sealed against each other by means of sealing disks, which are also arranged on the sealing housing. The gap between the rotors and the sealing disks is set at 0 mm during assembly. The sealing disks are worn off by the rotors during the operation to the extent necessary for the contactless run between the sealing disk and the rotor.

As a result of the given pressure level and the predetermined speed of rotation, dry-running screw compressors are provided with plain bearings or rolling bearings, corresponding to the calculated bearing force and the required service life.

The gearwheels, the seals as well as the bearing housing arranged on the pressure side are also adapted to the pressure conditions.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
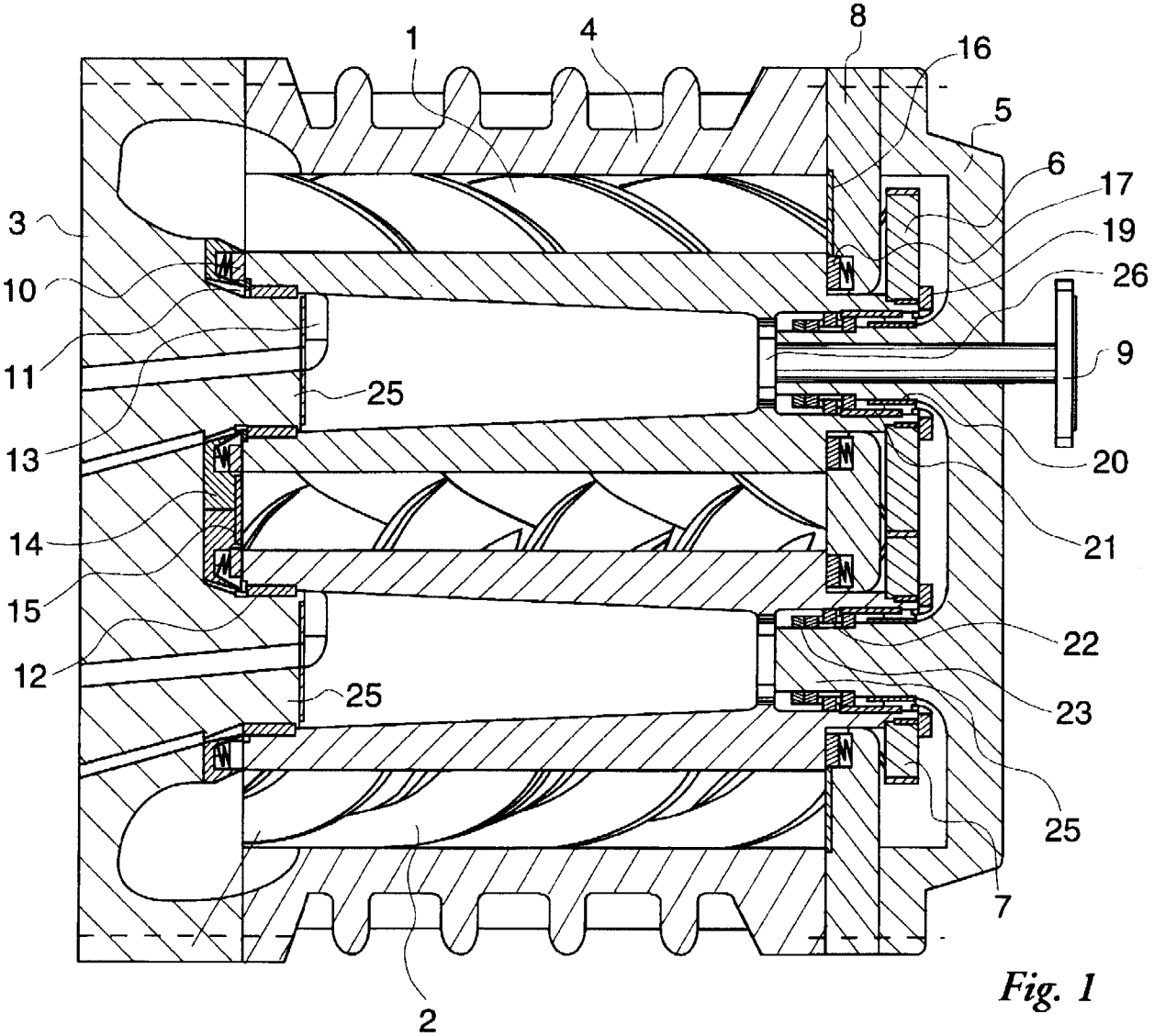
FIG. 1 is a longitudinal sectional view through a screw compressor with torsion shaft and rolling bearings or plain bearings for low bearing load.

Corresponding to FIG. 1, the suction-side bearing housing 3, with suction nozzle (not shown in FIG. 1 and FIG. 2), is provided on its inside with a journal 25 for engaging the hole in the ribbed rotor 1 and with another journal 25 for engaging the grooved rotor 2.

The pressure-side bearing housing 5, with discharge nozzle (not shown in FIG. 1 and FIG. 2) also has journals 25 on its inside. One of these journals 25 engages the hole in the ribbed rotor 1, and the other, the hole in the grooved rotor 2. Both bearing housings 3, 5 are detachably fastened to the compressor housing 4.

Thus, the rotors 1, 2 within the compressor housing 4 comprise only the helically geared part of the ribbed rotor 1 and the helically geared part of the grooved rotor 2, in the end of which central holes are prepared for accommodating the journals 25.

In the exemplary embodiment according to FIG. 1, the drive of the compressor is located at the ribbed rotor 1 on the pressure side.

The rotors 1, 2 are mounted on the pressure-side journals 25 in radial bearings and thrust bearings 20, 22, which are held by spacer rings 21 and are secured by corrugated nuts 23. On the suction side, the rotors 1, 2 are mounted in radial bearings 12 on the journals 25.

Oil wipers 13 with a drain channel through the bearing housing 3 are arranged on the suction side within the holes of the rotors 1, 2 and between the ends of the journals 25.

The ribbed rotor 1 is driven on the pressure side by means of a torsion shaft 9 with coupling flange. This torsion shaft is led through a hole in the pressure-side bearing housing 5 and the journal 25, and on the inner end it has a thickening 26 for example: polygon profile, torsionally stiff self aligning coupling or equivalents, which is located in a recess of the hole of the ribbed rotor 1 or, in FIG. 2, of the hole of the gearwheel 6'. A positive-locking connection is established as a result between the torsion shaft 9 and the ribbed rotor 1.

The gearwheels 6', 7' are connected to the rotors 1, 2 by means of spur gear couplings (permanent torsionally stiff couplings with radial designed teeth).

Gas seals 10 are located on the suction side of the faces of each rotor. Gas seals 17 are located on the pressure side of the faces of each rotor. These gas seals 10 and 17 seal the compression space against the atmospheric side.

The sealing between the tooth spaces of the rotors 1, 2 is ensured by scaling disks 15 in the suction-side sealing housing 14 and sealing disks 16 in the pressure-side sealing housing 8 which are inserted and fastened. These scaling disks 15 and 16 may be formed of a sintered polytetraflourethylen (PTFE)-mica mixture or a material possessing properties similar to a sintered polytetraflourethylen (PTFE)-mica mixture.

To maintain the distance between the rotor faces of the ribbed rotor 1 and of the grooved rotor 2, a differential gear is inserted between the pressure-side sealing housing 8 and the bearing housing 5.

This differential gear comprises a gearwheel 6 for the ribbed rotor 1 and a gearwheel 7 for the grooved rotor 2 with the necessary pressure-side bearing securing means 19.

Figure 2:
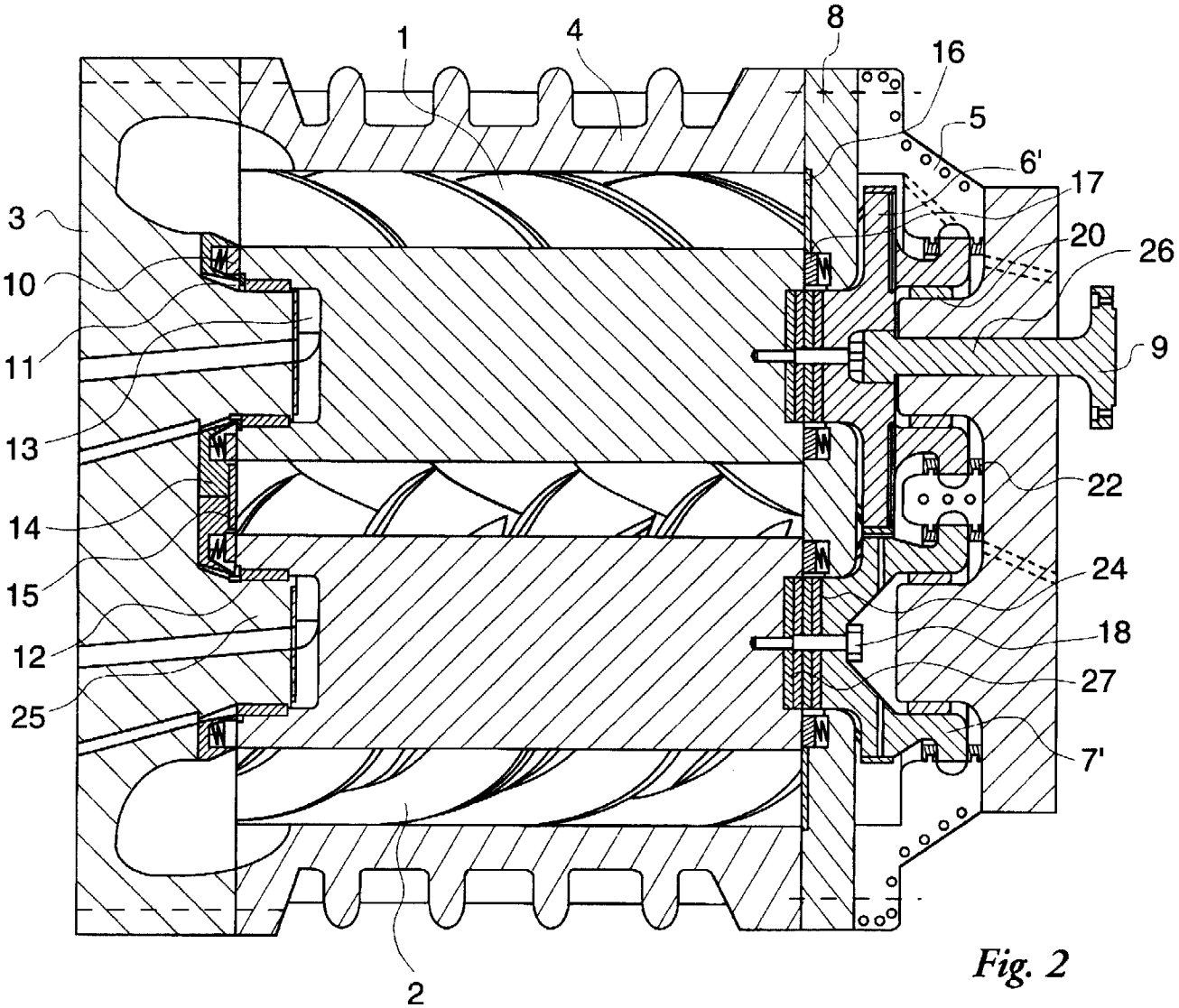
FIG. 2 is a longitudinal sectional view through a screw compressor with torsion shaft and plain bearings for high bearing loads.

FIG. 2 shows the design of a screw compressor with radial bearings 12 and 20, which is designed for high bearing load.

Compared with the exemplary embodiment according to FIG. 1, the pressure-side bearing housing 5 is designed such that broader gearwheels 6' are used at the ribbed rotor 1 and likewise broader gearwheels 7' are used at the grooved rotor 23, and larger radial and thrust bearings 20, 22 are used.

While specific embodiments of the invention have been shown and described in detail to illustrate the application of the principles of the invention, it will be understood that the invention may be embodied otherwise without departing from such principles.

What is claimed is:

1. A dry-running rotor compressor connected to a compressor device, the compressor comprising:

a helically geared ribbed rotor with a pressure side end and a suction side end, said ribbed rotor including a suction side end hole and a pressure side end hole;

a helically geared grooved rotor with a pressure side end and a suction side end, said ribbed rotor intermeshing with said grooved rotor, said grooved rotor including a suction side end hole and a pressure side end hole;

a suction-side bearing housing including a ribbed rotor suction side journal extending into said ribbed rotor suction side end hole and a grooved rotor suction side journal extending into said grooved rotor suction side end hole, said ribbed rotor suction side journal and said grooved rotor suction side journal being provided with one of plain bearings and roller bearings mounted between said ribbed rotor suction side journal and said ribbed rotor and between said grooved rotor suction side journal and said grooved rotor, said ribbed rotor suction side journal and said grooved rotor suction side journal being formed integrally with said suction side bearing housing;

a pressure-side bearing housing including a ribbed rotor pressure side journal extending into said ribbed rotor pressure side end hole and a grooved rotor pressure side journal extending into said grooved rotor pressure side end hole;

a torsion shaft of a coupling half for said compressor drive, said torsion shaft being led through a hole formed in one of said suction-side bearing housing and said pressure-side bearing housing and through one of said ribbed rotor suction side journal, said grooved rotor suction side journal, said ribbed rotor pressure side journal and said grooved rotor pressure side journal;

at least one gear wheel of a differential gear arranged between pressure-side ends of said ribbed rotor and said grooved rotor and said pressure-side bearing housing;

a pressure side sealing housing with pressure side sealing disks and seals arranged between said pressure-side ends of said ribbed rotor and said grooved rotor and said pressure-side bearing housing; and a suction-side sealing housing including suction-side seals and suction-side sealing disks arranged between suction-side ends of said ribbed rotor and grooved rotor and said suction-side bearing housing.

2. A rotor compressor according to claim 1, wherein two gear wheels are provided and a width of intermeshing of said gear wheels of said differential gear is set as a function of a pressure level and a value of a resulting torque of the rotor compressor.

3. A rotor compressor according to claim 1, further comprising a ribbed rotor spur gear coupling and a grooved rotor spur gear coupling, a ribbed rotor central screw and a grooved rotor central screw, said grooved spur gear coupling being detachably fastened to said pressure-side end of said grooved rotor via said grooved rotor central screw and said ribbed rotor spur gear coupling being detachably fastened to said pressure side end of said ribbed rotor via said ribbed rotor central screw, said spur gear couplings being arranged between said pressure-side ends of said ribbed rotor and said grooved rotor and said gear wheels.

4. A rotor compressor according to claim 1, wherein said seals of each off said ribbed rotor sealing housing and said grooved rotor sealing housing are gasproof seals of one of a static and dynamic design, or a combination of a static and dynamic design.

5. A rotor compressor according to claim 1, wherein said sealing disks of each of said ribbed rotor sealing housing and said grooved rotor sealing housing are formed of a sintered polytetraflourethylen-mica mixture or a material possessing properties similar to a sintered polytetraflourethylen-mica mixture.

6. A dry-running rotor compressor, comprising:

a helically geared ribbed rotor with a pressure side end and a suction side end, said ribbed rotor including a suction side end hole and a pressure side end hole;

a helically geared grooved rotor with a pressure side end and a suction side end, said ribbed rotor intermeshing with said grooved rotor, said grooved rotor including a suction side end hole and a pressure side end hole;

a suction-side bearing housing including a ribbed rotor suction side journal extending into said ribbed rotor suction side and hole and a grooved rotor suction side journal extending into said grooved rotor suction side end hole, said ribbed rotor suction side journal and said grooved rotor suction side journal being provided with one of plain bearings and roller bearings mounted between said ribbed rotor suction side journal and said ribbed rotor and between said grooved rotor suction side journal and said grooved rotor, said ribbed rotor suction side journal and said grooved rotor suction side journal being formed integrally with said suction side bearing housing;

a pressure-side bearing housing including a ribbed rotor pressure side journal extending into said ribbed rotor pressure side end hole and a grooved rotor pressure side journal extending into said grooved rotor pressure side end hole, said ribbed rotor pressure side journal and said grooved rotor pressure side journal being formed integrally with said pressure side bearing housing;

a torsion shaft of a coupling half for said compressor drive, said torsion shaft being led through a hole formed in one of said suction-side bearing housing and said pressure-side bearing housing and through one of said ribbed rotor suction side journal, said grooved rotor suction side journal, said ribbed rotor pressure side journal and said grooved rotor pressure side journal;

at least one gear wheel of a differential gear arranged between one of said suction side ends and said pressure-side ends of said ribbed rotor and said grooved rotor and said one of said suction-side bearing housing and said pressure-side bearing housing;

a pressure side sealing housing with pressure side sealing disks and seals arranged between said pressure-side ends of said ribbed rotor and said grooved rotor and said pressure-side bearing housing; and a suction-side sealing housing including suction-side seals and suction-side sealing disks arranged between suction-side ends of said ribbed rotor and grooved rotor and said suction-side bearing housing.

7. A rotor compressor according to claim 6, wherein two gear wheels are provided and a width of intermeshing of said gear wheels of said differential gear is set as a function of a pressure level and a value of a resulting torque of the rotor compressor.

8. A rotor compressor according to claim 6, further comprising a ribbed rotor spur gear coupling and a grooved rotor spur gear coupling, a ribbed rotor central screw and a grooved rotor central screw, said grooved spur gear coupling being detachably fastened to a pressure-side end of said grooved rotor via said grooved rotor central screw and said ribbed rotor spur gear coupling being detachable fastened to said pressure side end of said ribbed rotor via said ribbed rotor central screw, said spur gear couplings being arranged between said pressure-side ends of said ribbed rotor and said grooved rotor and said gear wheels.

9. A rotor compressor according to claim 6, wherein said seals of each of said ribbed rotor sealing housing and said grooved rotor sealing housing are gasproof seals of one of a static and dynamic design, or a combination of a static and dynamic design.

10. A rotor compressor according to claim 6, wherein said sealing disks of each of said ribbed rotor sealing housing and said grooved rotor sealing housing are formed of a sintered polytetraflourethylen-mica mixture or a material possessing properties similar to a sintered polytetraflourethylen-mica mixture.

* * * * *